US005753078A

United States Patent [19]

Koutitonsky et al.

[11] Patent Number: 5,753,078

[45] Date of Patent: May 19, 1998

[54] METHOD OF MAKING SURFACE COATED OR IMPREGNATED PAPER OR PAPERBOARD

[75] Inventors: Serge Koutitonsky, St. Lambert; Stephane Rousseau, Ville Loraine, both of Canada

[73] Assignee: Cartons St-Laurent, Inc./St. Laurent Paperboard, Inc., Montreal, Canada

[21] Appl. No.: 660,513

[22] Filed: Jun. 7, 1996

[51] Int. Cl.[6] ..... D21H 19/40; D21H 19/52; B05D 1/28

[52] U.S. Cl. ..... 162/135; 162/184; 162/163; 427/211

[58] Field of Search ..... 162/184, 135, 162/163, 158; 118/246, 248, 249, 258, 224, 227; 427/209, 211

[56] References Cited

U.S. PATENT DOCUMENTS

| | | | |
|---|---|---|---|
| 2,378,113 | 6/1945 | Van De Carr, Jr. | 162/173 X |
| 4,339,481 | 7/1982 | Beekhuis | 427/428 |
| 4,503,802 | 3/1985 | Keller et al. | 118/249 |
| 5,338,404 | 8/1994 | Lucas et al. | 162/163 |
| 5,567,277 | 10/1996 | Elliot et al. | 162/163 |

*Primary Examiner*—Donald E. Czaja
*Assistant Examiner*—Jose A. Fortuna
*Attorney, Agent, or Firm*—Emrich & Dithmar

[57] ABSTRACT

A method for making a surface coated or impregnated paper or paperboard by applying an aqueous additive dispersion to the wet web between the press and drying sections of a conventional paper or paperboard making machine. The aqueous additive dispersion is pre-metered onto a transfer roll and is applied to the wet web at a pressure nip between the transfer roll and a back-up roll. High solids content dispersions can be applied at high web speeds without tearing the web. The use of a high solids content aqueous dispersion having a solids content substantially equal to the solids content of the wet web at the point of application permits the method to be performed without increasing the drying load and therefore at an unreduced speed. The method contemplates the use of a hydrophillic transfer roll running in a direction opposite to the web, permitting a saturant to be impregnated into the web, and has particular application to the production of containerboard treated with a lignosulfonate saturant to improve strength and surface character.

14 Claims, 1 Drawing Sheet

METHOD OF MAKING SURFACE COATED OR IMPREGNATED PAPER OR PAPERBOARD

The present invention relates to a method of making a surface coated or impregnated paper or paperboard by applying an aqueous additive dispersion to the wet web at high speed.

BACKGROUND OF THE INVENTION

The paper and paperboard industry has long relied upon the addition of saturants and coatings to the surface of paper and paperboard to enhance performance and market value. A number of methods are well known in the art.

The application of saturants or coatings to a dry sheet surface is commonly carried out before the third dryer section of the paper making machine. For example it is conventional practice to locate a size press, or a pre-metering size press after the second dryer section of the paper machine. The paper web, at about 3–9% moisture, depending on the application, passes into the nip of the size press rolls and sizing solution is applied onto both sides of the web and is pressed into the paper. Twin roll size presses have conventionally been used to apply coatings to improve specific surface properties such as smoothness, pick resistance and water hold out and to apply saturants to impregnate the sheet and improve bulk strength properties such as ply bond and burst strength, stiffness and tensile strength, all directly related to ring crush, stiffness and concora strength.

Coating and impregnating apparatus suitable for use after the drying section of paper and paperboard making machines are well known in the art. For example, U.S. Pat. No. 3,647,525 Dahlgren discloses a liquid applicator system (LAS) in which the liquid is applied to the web a controlled quantity by means of a smoothly finished hydrophillic roller. Metering is accomplished by way of a doctor blade acting against the roller or by a transfer roll. However, as noted in Dahlgren, the apparatus is disclosed as being suitable to be installed in the normal web stream as the paper comes through the paper making or converting machine, after the paper is depleted of moisture.

The application of aqueous coatings and saturants after drying presents certain disadvantages. For example, in a size press, the paper typically picks up about one pound of water for every pound of fibre, particularly with low basis weight paperboard. The high moisture content requires additional drying energy, which constitutes a major expense in paper making. In addition, major capital expenditures are required such as extending the drying section and relocating the reelstand and winder. This can often not be accomplished if inadequate physical space is available to extend the paper machine length.

It is also known to apply certain additives at the wet end of the paper forming section. For example, wet end addition of cationic starches and lignins is used to improve the strength of paperboard grades used in the packaging industry. However, the addition of additives at the wet end can give rise to broke repulping difficulties in the stock preparation section of the paper mill. Moreover, wet end chemistries can adversely affect paper machine productivity by clogging forming wires and producing press felt "stickies" affecting drainage. In addition, the high chemical loads and oxygen demands in the white water from wet end chemistries can adversely effect the operation of the effluent treatment plant. One example of a wet end application of coatings is described in U.S. Pat. No. 5,152,872 Racine. In Racine, the coating is applied to the wet web between the forming section and the press section with the result that the web must be supported by a wire or porous fabric during coating. This requires substantial modification to the forming and press sections of the paper making machine. Moreover, the addition of coating before the press section causes some coating material to be entrained in the white water. As noted in Racine, it may be necessary to set up a separate associated system to remove coating material from the white water.

It is also known to apply coating materials to paper after the press section and before the drying section. For example, in U.S. Pat. No. 2,229,620 Bradner, there is described a method of applying an aqueous liquid coating material comprising an adhesive and pigment in suspension to one surface only of the web before any drying, and then wiping off that part of the coating material which lies above the level of the surface fibres, and thereafter drying the web. The coating is applied with a reverse roll and the wiping action to remove excess coating is accomplished by a rod wiper or a second reverse roll wiped clean by a rubber or other suitable doctor blade. However, the Bradner method is severely limited in the speed that it can run. As disclosed on Bradner, the wet web was coated and wiped at a speed of 300 feet per minute. Modern paper and paperboard making machines run at speeds of 1800 fpm and up. At such speeds, the wiping pressure of the rod and the hydrodynamic pressure exerted by a rod in the pigmented liquid coating can cause web breakage. The wiping of a weak wet web with a rod or other wiper such as disclosed in Bradner cannot be performed at high speeds unless the solids content or viscosity of the coating is very low. Even with low solids or viscosity coatings, very delicate control over the speeds of the various rollers would be required and frequent breaking of the web could be expected.

The low solids content (17–23.5%) coating applied with the Bradner apparatus substantially increases the water content of the web before it enters the dryer section. As a result, with a fixed drying capacity, it would be necessary to run the paper machine at a slower speed to dry the additional water introduced into the wet web by would likely be required. In addition, the reverse roll coater of Bradner is also driven against the web without any backing roll and relies primarily on centrifugal force to pressurize the liquid coating material into the wet web. However, at high speeds, centrifugal force cannot be used to pressurize the coating/saturant into the web without splashing the liquid on the sheet and losing precision of the applied weight. As a result, the Bradner system is unsuitable for use on a high speed paper or paperboard making machine.

Accordingly, there is a requirement for a method and apparatus to coat and saturate a wet paper or paperboard web between the press and drying sections that is effective at high speeds.

SUMMARY OF THE INVENTION

In accordance with the present invention, there is provided a method for making a surface coated or impregnated paper or paperboard by applying an aqueous additive composition to the wet web between the press and drying sections of a conventional paper or paperboard making machine. By using a method in which the aqueous additive dispersion is metered on the transfer roll and not on the web, high solids content dispersions can be applied at high web speeds without tearing the web. The use of a high solids content aqueous dispersion having a solids content substantially equal to or greater than the solids content of the wet web at the point of application permits the method to be performed without increasing the drying load and therefore at an unreduced speed. The method contemplates the use of a hydrophillic transfer roll running in a direction opposite to the web, permitting a saturant to be impregnated into the web, and has particular application to the production of containerboard treated with a lignosulfonate saturant to improve strength and surface characteristics.

Thus in accordance with the present invention, there is provided a method of making a surface coated or saturated paper or paperboard comprising the steps of forming a wet web of paper or paperboard, subjecting said web to at least one pressing operation, subjecting at least one side of said web to a liquid application operation and drying said web, said liquid application operation being carried out after all pressing operations and before any drying operations, said liquid application operation comprising the steps of metering a smooth uniform film of an aqueous additive dispersion onto a rotating transfer roll having a hydrophillic metal liquid receptive surface, rotating at web direction and substantially at web speed a smooth surfaced resilient back-up roll in pressure-nip relationship with said transfer roll and contacting said metered film on said rotating surface of said transfer roll with one side of said web at the pressure nip.

In accordance with another aspect of the present invention, the transfer roll is rotated opposite to the web direction such that the metered film contacted with the web is saturated into the web or is rotated in the web direction such that the metered film contacted with the web is coated onto the surface of the web.

In accordance with another aspect of the present invention, a film of the aqueous additive dispersion is applied to a metering roll having a smooth resilient surface rotating in the web direction at about web speed and the film on the surface of said metering roll is contacted with the surface of said transfer roll.

BRIEF DESCRIPTION OF THE DRAWINGS

In drawings which illustrate embodiments of the invention.

DETAILED DESCRIPTION OF THE INVENTION

Figure 1:
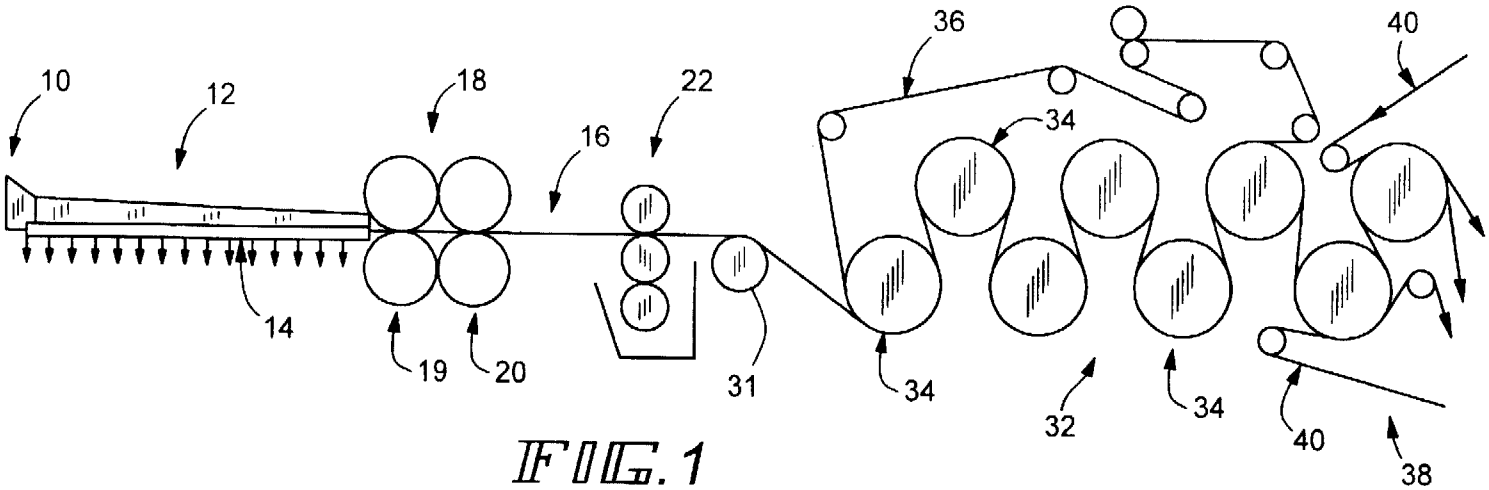
FIG. 1 is a schematic drawing of a paper or paperboard making machine using the method of the present invention for applying an aqueous additive dispersion to one side of the web.

Referring to FIG. 1, paper or paperboard fibre furnish is supplied from headbox 10 onto a conventional forming section generally designated by the reference numeral 12. Forming section 12 comprises forming mesh 14, often referred to as the "wire". Wire 14 is schematically represented in FIG. 1, and in practice is an endless belt that is driven at high speed away from the headbox over table rolls or foils and back to the headbox through return rolls (not shown). The dilute pulp suspension or "stock" is delivered in a homogeneous jet from headbox 10 across the width of moving wire 14. Water from the stock (known as "white water") drains through wire 14 and is collected and sent back to dilute the pulp coming from the pulp mill.

Wet web 16 is separated from wire 14 and is passed through a conventional press section, generally designated by reference numeral 18. In press section 18, the wet web 16 and an endless porous felt (not shown) are pressed between successive pairs of rolls, two of which are shown and designated by reference numerals 19 and 20. As the wet web 16 and the felt pass through the nip between the press rolls, water is squeezed out. In press section 18, the web loses sufficient water and gains mechanical strength such that it is self-supporting.

Figure 2:
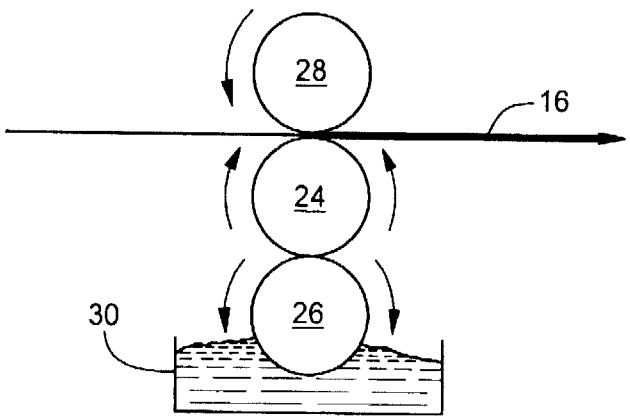
FIG. 2 is a schematic drawing of a liquid application system suitable for use in the present invention.

Web 16 passes from press section 18 through a coater/saturator, generally designated by reference numeral 22. Coater/saturator 22 is of the type described in U.S. Pat. No. 3,647,525 Dahlgren which is incorporated herein by reference. As shown in FIG. 2, coater/saturator 22 is comprised of transfer roll 24, metering roll 26 and back-up roll 28. The aqueous additive dispersion to be applied to wet web 16 is contained in reservoir 30.

Transfer roll 24 is an etched finished hard surfaced roll that has been surfaced treated to render it hydrophillic. As described in Dahlgren, applicator roll can be a metal roller, such as steel, which is plated with a hard surfacing material such as chrome or nickel and treated to render it hydrophillic.

Metering roll 26 is a smoothly surfaced resilient roll that rotates in and picks up the aqueous additive dispersion on its surface. Metering roll 26 is in surface contact with and applies a smooth uniform film of the aqueous additive dispersion to transfer roll 24. The amount of aqueous additive dispersion transferred to transfer roll 24 can be precisely metered by adjusting the surface pressure relationship between rolls 26 and 24.

Back-up roll 28 has a smooth resilient surface such a rubber and is arranged to rotate in pressure-nip relationship with transfer roll 24.

Web 16 passes from press section 18 into the nip between transfer roll 24 and back-up roll 28. Transfer roll 24 can be driven either in the forward web direction or in the reverse direction, with the former being more suitable for surface coating applications and the latter being preferred for web saturation applications. The direction of metering roll 26 is such that its surface is travelling in the same direction as that of transfer roll 24 at the point of contact. The relative speed of the surface of transfer roll 24 against wet web 16 can be adjusted to control the rate of application or degree of penetration of the aqueous additive dispersion. Back-up roll 28 is driven in the same direction as wet web 16, at about web speed. A suitable commercially available machine for use as coater/saturator 22 is manufactured by Coating & Moisturising Systems Incorporated and is sold under the trade-mark LAS CM.

Wet web 16 passes from coater/saturator 22 to a first dryer section, generally designated by the numeral 32. First dryer section 32 is comprised of a large number of steam heated drums or dryer cans 34 about which web 16 passes. Heat transfer from dryer cans 34 to the web evaporates water and reduces the moisture content of the web to required levels. Conventional dryers typically have three sections. In the first, the temperature of the web is increased, and in the second and third sections, the bulk of the evaporation occurs. It is conventional practice to located a size press between the second and third dryer sections such that the moisture absorbed by the web in the size press can be evaporated in the third dryer section.

In the present invention, since the aqueous additive dispersion is applied to the wet web before drying, a special felt configuration in first dryer section 32 is required. Referring to FIG. 1, felt 36 passes in serpentine fashion around dryer cans 34 and is disposed between wet web 16 and the first dryer can 34. With this configuration, the aqueous additive dispersion that has been applied to the underside of web 16 by transfer roll 24 does not come into contact with felt 36 when passing around first dryer can 34, and accordingly does not stain or transfer to felt 36 as it would otherwise do if web 16 passed between felt 36 and first dryer can 34. Such a configuration is known to those skilled in the art as a Unorun type single felted dryer section. Another suitable dryer arrangement is found on some older paper machines and uses a single felt that travels on the top only of the dryer cans. Such a system can be used so long as the treated side of the web does not come into contact with the single felt in the first dryer section.

As web 16 is driven around first dryer can 34, water is drawn into felt 36 from web 16 toward the first dryer can thereby drawing the solids in the aqueous additive dispersion deeper into web 16. This greatly reduces or eliminates the amount of aqueous additive dispersion material that is transferred to the surface of the second dryer can 34. The small amounts, if any, transferred to second dryer can 34 can be removed by the use of a scraper blade. In addition, the outer surface of the second dryer can, and if necessary, the fourth dryer can 34, may advantageously be coated with Teflon* (*trade-mark) roll release surface coating or other suitable non-stick surface. Because web 16 is supported by felt 36 throughout first dryer section 32, moisture is continually drawn away from the side of web 16 opposite the coated side, with the result that the aqueous additive dispersion can be drawn into web 16.

Treated web 16 is passed from first dryer section 32 to a second dryer section generally designated by reference numeral 38. Second dryer section 38 comprises a large number of dryer cans, two of which are shown in FIG. 1. Web 16 leaves the last dryer can of first dryer section 32 and is passed around the dryer cans in second dryer section 38 in serpentine fashion. Web 16 is disposed between felts 40 and the surfaces of the dryer cans in conventional manner in order to reduce its moisture content to the required final level.

It is important that the wet web 16 enter and leave at a tangent to surfaces of transfer roll 24 and back-up roll 28 at their point of contact at the pressure nip. This will ensure that the saturation or impregnation of the web takes place at the nip and allows the operator to accurately control the application of saturant chemistry through control of the nip set-up and pressure. Accordingly, it may be necessary to include a support roll 31 such as shown in FIG. 1 in order to ensure that the wet web passes straight through the pressure nip without wrapping around transfer roll 24 or back-up roll 28.

It has been found that the present invention is particularly suited for applying aqueous additive dispersions to wet web 16 travelling at high speed. In particular, in coater/saturator 22, the coating is pre-metered at the nip between metering roll 26 and transfer roll 24 which produces a smooth and even film of aqueous additive dispersion on the surface of transfer roll 24. As a result, almost all of the coating that is pre-metered onto transfer roll 24 can be transferred to wet web 16. This obviates the requirement to wipe the wet web with a rod coater or other similar device which, as a result of wiping pressure or hydrodynamic pressure, can easily tear the weak wet web at high speeds. The hydrophilic nature of transfer roll 24 permits it to carry substantial quantities of pre-metered aqueous additive dispersion onto the web at very high paper machine speeds without splashing the dispersion onto web 16 and losing precision of the applied weight. Back-up roll 28 which is driven in the web direction at web speed accurately pressure nips web 16 to the surface of transfer roll 24 and ensures penetration of the aqueous additive dispersion into the web. By driving hydrophillic transfer roll 24 in a direction opposite to web 16, the aqueous additive dispersion can be pushed further into the web. The degree of penetration can also be increased by running transfer roll 24 at a high speed relative to the web speed. The centrifugal force imparted to the liquid film causes it to be forced deeply into the web for saturant applications.

Figure 3:
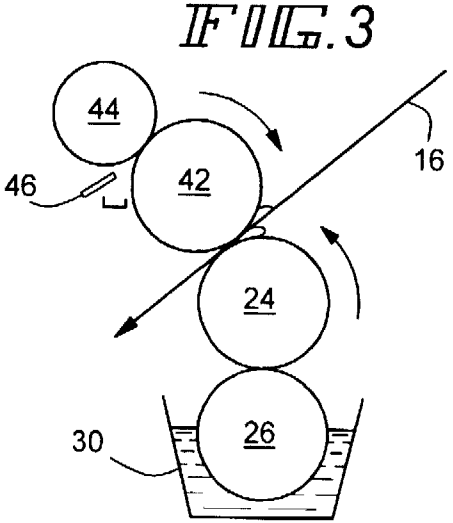
FIG. 3 is a schematic drawing of a liquid application system suitable for use in the present invention for applying an aqueous liquid dispersion to both sides of the web simultaneously.

For applications where two-sided coating or impregnation is desired, two liquid application systems are used. It is possible to configure back-up roll 28 to also act as a transfer roll for the side of the web opposite transfer roll 24. Such an arrangement is shown in FIG. 3. Metering roll 26 and transfer roll 24 are the same as that in FIG. 2. and are used to apply the aqueous additive dispersion to the underside of web 16. As shown in FIG. 3, transfer roll 24 is run in either the forward or reverse direction to apply the aqueous additive dispersion to web 16. In addition, the top side of web 16 is treated by transfer roll 42 and metering roll 44. Transfer roll 42 is a smooth surfaced hardened rubber roll and metering roll 44 is a grooved metal roll. Aqueous additive dispersion can be sprayed into the nip 46 between transfer 42 and metering roll 44 with the result that a smooth even film of aqueous additive dispersion can be pre-metered onto transfer roll 42 before contact with web 16. Transfer rolls 24 and 42 can be run in pressure-nip relationship because of the resilient surface characteristics of roll 42, thereby permitting simultaneous two sided liquid application at the nip. However, because of its rubber surface, transfer roll cannot be run in reverse direction without danger of tearing wet web 16. A suitable commercially available machine for use as transfer roll 42 and metering roll 44 is manufactured by BTG and is sold under the trade-mark HSM (High Speed Metering).

For two sided coating/saturating, two liquid application systems such as shown in FIG. 2 can be disposed on each side of the wet web with the pressure nips spaced apart in the web direction. In such a case the coating/saturating operations are performed sequentially as the chrome hydrophillic rolls cannot be run in pressure nip relationship.

It has been found that the present invention has particular application for treating containerboard to improve its strength characteristics. One known method for improving the strength of containerboard involves treatment with sulfonated lignin from waste liquor from conventional chemical pulping processes. For example, as described in U.S. Pat. No. 4,191,610 Prior, there is described the use of modified waste sulphite liquor to improve strength. Prior discloses that the liquor can be applied either at the wet press, size press or at the corrugator. Prior notes that when added at the wet press, the drying requirements on the paper machine is drastically reduced with the result that the paper machine can be run at a much higher efficiency and speed. However, wet press application requires substantial modification to the press section and contributes to contamination of the white water. The present invention has been found to enable the application of lignosulfonate liquor to the wet web between the press and drying sections, without increasing the drying requirements and permit a precise degree of control over saturant penetration in the sheet providing effective control of the resulting sheet strength.

Drying requirements are increased when the particular coating or saturant being applied has the effect of increasing the moisture content of the web. Drying requirements will be unaffected if the coating composition has a moisture content that is about equal to that of the web at the point of coating application. The moisture content of the paper web between the press and drying sections of conventional paper and paperboard machines is in the range of about 50–60%, with about 55% being typical. Accordingly, if a saturant is to be applied to a wet web between the press and drying sections without affecting the drying requirements, it will need to be formulated to a solids content in the range of 40–50%.

EXAMPLE

A test run for both one and two sided coating was carried out on an off-line pilot coater/saturator which employed the liquid application system shown in FIG. 3. The liquid application system on the bottom side of the web consisted of pick-up roll 26 rotating in contact with the coating composition in reservoir 30. Pick-up roll 26 has a smooth rubber surface and pre-meters the coating composition in a smooth and uniform film onto the chrome hydrophillic surface of transfer roll 24. On the top side of the web, an HSM machine manufactured by BTG comprising a grooved steel metering roll 44 and a smooth soft rubber surfaced transfer roll 42 having a hardness of 10 P & J was used. Softer transfer rolls having a hardness of 100 P & J are also suitable. The saturant was applied to pick-up roll 26 for single sided coating tests and was also applied as a jet to the nip 46 between metering roll 44 and transfer roll 42 for two sided treatment. Transfer rolls 24 and 42 were disposed in pressure-nip relationship with the web 16 passing through nip 46. Both transfer rolls 24 and 42 were driven in the web direction and at web speed of 400 m/min. The pilot coater saturator was equipped with a flotation dryer, air turning bars and a long draw to the winder, and was equipped with tension controls that can handle weak lightweight coated sheets at high speeds.

Wet webs having moisture contents of 20%, 40% and 54% were treated. The tests at 40% and 54% moisture were intended to simulate the moisture content of a wet web as it leaves the press section of a conventional paperboard machine, typically between 45% and 55% moisture. The webs being treated were 150 gsm Chemcor II* (Trade-mark) previously dried sheets of corrugating medium manufactured by St. Laurent Paperboard Inc. that were gradually rewetted in three stages to moisture levels of 40% and 54% respectively. A saturant mix consisting of sodium silicate modified to enhance water resistance and malleability and unmodified sodium silicate in a ratio of 70/30 and a solids content of 42% was applied in one and two sided runs. Because the test apparatus was initially designed as a lightweight coating and surface sizing plant, for the 40% and 54% moisture runs, it did not have enough drying capacity to dry the finished sheets sufficiently to permit use or performance testing. However, this test demonstrated that a weak wet web could be evenly treated on one or two sides by nipping it between a pre-metered hydrophillic LAS chrome roll and a rubber roll under pressure and at high speeds, without tearing of the web and without splashing liquid saturant in the air. The test also demonstrated that the degree of moisture of the web at the point of treatment has a direct effect on the extent to which the web absorbs high solids saturant chemistry.

The tests at 20% moisture were intended to allow the treated web to be dried, converted and subjected to performance testing. The webs being treated were 150 gsm Chemcor II* (Trade-mark) previously dried sheets of corrugating medium manufactured by St. Laurent Paperboard Inc. Both one and two sided treatment of the web was carried out with the saturant at 20% solids to help penetration as well as drying of the treated sheet to a final moisture content of 6%, which is normally required in commercial applications. The object of the 20% moisture test was to simulate the treatment of a wet web emerging from the second press section with a modified sodium silicate material, thereby enhancing the dry strength of corrugating medium. Test results on both one and two sided treated web properties are given in Table 1. For purposes of comparison, tests results for untreated 150 gsm Chemcor II corrugating medium and a wax coated higher basis weight 161 gsm Chemcor I corrugating medium are included in Table 1.

TABLE 1

| Property | Chemcor II Untreated | Chemcor II One side | Chemcor II Two side | Chemcor I Wax |
|---|---|---|---|---|
| Add-on (Lbs/msf) | — | 2.0 | 3.4 | 4.3 |
| Basis Weight (Lbs/msf) | 32 | 34 | 35 | 38 |
| Concora (Lbsf) | 75 | 107 | 121 | 89 |
| Indexed Lbf/Lbs/msf) | 2.38 | 3.17 | 3.50 | 2.34 |
| Tensile Strength (Lbsf) | 45 | 48 | 56 | 62 |
| Indexed (Lbf/Lbs/msf) | 1.43 | 1.53 | 1.79 | 1.97 |
| Ring Crush CD (Lbsf) | 42 | 31 | 32 | 59 |
| Indexed (Lbf/Lbs/msf) | 1.34 | 0.91 | 0.92 | 1.55 |
| Fluted Crush CD (Lbsf) | 50 | 70 | 83 | 74 |
| Indexed(Lbf/Lbs/msf) | 1.59 | 2.09 | 2.41 | 1.94 |
| Stfi Compression (Lbsf/in) | 18 | 22 | 25 | 22 |
| Indexed (Lbf/in/Lbs/ms) | 0.57 | 0.65 | 0.72 | 0.58 |

The untreated, one side treated, two side treated and wax treated corrugating medium samples of Table 1 were converted into corrugated board. For the untreated, one-sided and two-sided samples, the inside linerboard facing was 42 Kraft and the outside linerboard facing was 57 HP Kraft. For the wax sample, the inside linerboard facing was 42 Kraft and the outside linerboard facing was 52 HP Kraft. No alteration was made to enhance the bond strength of the treated sheet with the corrugator speed kept at a normal speed of 400 fpm used to run waxed boxes. The corrugated board was tested and the results are shown in Table II.

TABLE II

| Property | Chemcor II Untreated | Chemcor II One side | Chemcor II Two side | Chemcor I Wax |
|---|---|---|---|---|
| Edge Crush 50% RH (Lbsf/in) | 50 | 54 | 54 | 53 |
| Edge Crush 90% RH (Lbsf/in) | 42 | 44 | 41 | 36 |
| Pin Adhesion 50% RH (Lbsf) | 88 | 89 | 92 | 107 |
| Pin Adhesion 90% RH (Lbsf) | 74 | 72 | 70 | 72 |
| Flat Crush 50% RH (psi) | 49 | 58 | 58 | 38 |
| Flat Crush 90% RH (psi) | 38 | 39 | 40 | 24 |
| T/B Comp 50% RH (Lbsf) | 949 | 957 | 975 | 941 |
| T/B Comp 90% RH (Lbsf) | 755 | 730 | 743 | 713 |

Good fibre tear was observed on the combined corrugated board, which indicates adequate anchoring of the corrugating adhesive into the treated medium surface. The results of Table II indicate that the saturation of the wet web with the configuration of FIG. 3 can result in dry and wet strength characteristics that can compete in stacking strength with containerboard of higher basis weight made in a conventional process.

EXAMPLE

Further tests were carried out to use the coating/saturating process of the present invention in conjunction with a pilot paper making machines in which a wet web (as opposed to a rewetted web) could be treated and the flotation dryers could be replaced with steam heated cans and a Unorun single felt. In addition, the further tests evaluated the ability of the process of the present invention to saturate the web with lignosulfonate based chemistry instead of sodium silicate chemistry. Tests were carried out in which the saturant was (a) solely lignosulfonate based spent liquor, (b) lignosulfonate based spent liquor blended with starch on a 1/1 dry basis ratio, and (c) lignosulfonate based spent liquor blended with mica on a 1/1 dry basis ratio. All saturants had a solids level of about 40%. The coating/impregnating system of FIG. 1 was used.

For the pilot paper machine test, a coater manufactured by Coating & Moisturising Systems Incorporated and sold as under the designation Liquid Application System Model 103 as a conventional off-line moisturizer or coater was installed at the end of a conventional paper press section and before a conventional single tier dryer section having a single felt. The liquid application system consisted of a rubberized pick-up roll, a chrome hydrophillic transfer roll and a rubberized back-up roll. The saturant mixture of having a solids concentration of 40% was pumped to the reservoir under the pick-up roll. The transfer roll was run in the reverse direction at −50/min, the back-up roll was run in the forward direction +35 m/min and the web speed was 30 m/min. Test results on the resulting treated sheet are given in Table III.

TABLE III

| Property | Chemcor II Untreated | Chemcor II Ligno-sulfonate | Chemcor II Ligno/ Starch | Chemcor I Ligno/ Mica |
|---|---|---|---|---|
| Add-on (Lbs/msf) | — | 3.0 | 3.0 | 3.0 |
| Basis Weight (Lbs/msf) | 20 | 23 | 23 | 23 |
| Concora (Lbsf) | 47 | 59 | 66 | 57 |
| Indexed (Lbf/Lbs/msf) | 2.3 | 2.5 | 2.9 | 2.5 |
| Tensile Strength (Lbsf) | 37 | 34 | 34 | 37 |
| Indexed (Lbf/Lbs/msf) | 1.8 | 1.5 | 1.5 | 1.6 |
| Fluted Crush CD (Lbsf) | 52 | 65 | 70 | 61 |
| Indexed (Lbf/Lbs/msf) | 2.5 | 2.8 | 3.0 | 2.6 |
| Ring Crush CD (Lbsf) | 30 | 37 | 36 | 36 |
| Indexed (Lbf/Lbs/msf) | 1.5 | 1.6 | 1.6 | 1.6 |
| Porosity (ml/min) | 258 | 167 | 250 | 245 |
| Smoothness (ml/min) | 402 | 414 | 410 | 405 |
| Water Absorption (gsm/5 min) | 157 | 150 | 124 | 95 |

The results of Table III indicate that up to 15% of the OCC fibres in the furnish can be replaced with a less expensive lignosulfonate based chemical strength enhancer while still maintaining the same strength characteristics, using the method of the present invention.

EXAMPLE

Further tests were carried out to use the coating/saturating process of the present invention in conjunction with a commercial paper making machine. The coating/impregnating system of FIG. 1 was used.

For the commercial paper machine test, a coater manufactured by Coating & Moisturising Systems Incorporated and sold as under the designation Liquid Application System Model 103 as a conventional off-line moisturizer or coater was installed at the end of a conventional paper press section manufactured by Groupe Laperriere & Verrault and sold under the model name Jumbo Press and before a conventional Unorun type dryer section. The liquid application system consisted of a rubberized pick-up roll, a chrome hydrophillic transfer roll and a rubberized back-up roll. A wet web was formed at 400 m/min of 100% OCC fibres. The back-up roll and the transfer roll of the liquid application system were brought to 400 m/min in the web direction with the nip open. A 4 inch tail was cut from the wet web with a water jet and was passed through the nip and widened to 30 inches. The transfer roll was stopped and reversed in rotation to −400 m/min. Sizing solution of cooked starch at 8.5% solids was pumped to the reservoir under the pick-up roll and the nip between the back-up and transfer rolls was closed. The wet web tail passed easily and after a few minutes of impregnation with the starch, the coating fluid was changed to a mixture having a solids concentration of 40% comprising 50% starch and 50% lignosulfonate based spent liquor on a dry basis.

The wet web withstood the saturating operation without breaking. Some difficulty did arise with web breakage between the first and fourth dryer can due to a build-up of the saturant mix on the second and fourth dryers, due to the fact that the coated side of the web was in contact with these dryers. After a few minutes, this problem abated, likely because the temperature of the build-up came to equilibrium with the dryer can surface. This problem of build-up on the second and fourth dryer cans can be avoided by installing a doctor blade on the dryers to remove the buildup, and/or by coating the dryer can surfaces with a non-stick surface such as Teflon* (*Trade-mark). The finished sheet had a basis weight of 112 g/m$^2$ and a moisture content of 6.5%.

It has been found that the ability to impregnate lignosulfonate based saturant chemistries thoroughly and evenly into the wet web requires control of a number of process variables. Acceleration of the penetration of saturant from the bottom side of the wet web and removal of water from the top side are enhanced by reduction of the saturant surface tension at the coater/saturator nip, increasing the wet web and saturant temperature at the point of the coater/saturator nip and optimisation of pick-up and transfer roll speeds. In certain circumstances, it may be advisable to provide additional IR energy after the coater/saturator to accelerate removal of water from the top of the wet web prior to it coming into contact with the dryer cans.

The importance of this is due to the fact the resulting treated containerboard strength is a function of the degree of penetration of the saturant solids across the fibre network thickness. Failing to penetrate the wet fibre network with saturant solids or confining the movement of these solids at the centre of the web as the same is dried through a symmetrical dryer can labyrinth [saturant water and solids will move towards the heat source where the partial pressure of water is reduced by evaporation] will result in diminishing anticipated fibre savings and strength enhancement.

While the present invention has been described primarily in connection with the treatment of containerboard, it is also useful to surface treat newsprint and other lightweight papers. In addition, the present invention can also be used to replace the high value added cast coated magazine grade paper that is manufactured at low speeds.

The foregoing description of the preferred embodiments of the present invention is provided for the purposes of illustration and is not intended to limit the invention to the precise embodiments disclosed. It is intended that the scope of the invention be defined by the claims appended hereto.

We claim:

1. A method of making a surface coated or saturated paper or paperboard comprising the steps of forming a wet web of paper or paperboard, subjecting said web to at least one pressing operation, subjecting at least one said of said web to a liquid application operation and drying said web, said liquid application operation being carried out after all pressing operations and before any drying operations, said liquid application operation comprising the steps of metering a smooth uniform film of an aqueous additive dispersion onto a rotating transfer roll having a hydrophilic metal liquid receptive surface rotating, rotating at web direction and substantially at web speed a smooth surfaced resilient back-up roll in pressure-nip relationship with said transfer roll and contacting said metered film on said rotating surface of said transfer roll with one side of said web at the pressure nip, said aqueous additive dispersion having a moisture content that is approximately equal to or less than the moisture content of the wet web after all pressing operations.

2. The method of claim 1 wherein the transfer roll is rotated opposite to the web direction such that the metered film contacted with the web is saturated into the web.

3. The method of claim 1 wherein the transfer roll is rotated in the web direction such that the metered film contacted with the web is coated onto the surface of the web.

4. The method of claim 1 wherein the step of metering comprises the steps of applying a film of said aqueous additive dispersion to a rotating metering roll having a smooth resilient surface and contacting said film on the surface of said metering roll with the surface of said transfer roll.

5. The method of claim 1 including the additional step of coating or saturating the other side of said web including providing said back-up roll with a smoothly finished liquid receptive surface, metering a smooth and uniform film of an aqueous additive dispersion onto the rotating surface of said back-up roll, and contacting said metered film on said rotating surface of said back-up roll with the other side of said web at the pressure-nip.

6. A method of making a surface coated or saturated paper or paperboard comprising performing the method of claim 1 sequentially on each side of the wet web with said respective pressure-nips spaced apart in the web direction.

7. The method of claim 1 wherein the step of drying comprises the steps of contacting the other side of said web with an endless absorbent felt moving at web direction and speed, passing said web and felt in heat transfer relationship in serpentine fashion around a plurality of heated dryer cans rotating at web speed and direction, said felt being disposed against the surface of the first dryer and successive alternate dryer cans and said web being disposed against the second and successive alternate dryer cans.

8. The method of claim 1 wherein the step of drying comprises the steps of contacting the other side of said web with an endless absorbent felt moving at web direction and speed, passing said web and felt in heat transfer relationship with a plurality of heated dryer cans rotating at web speed and direction with said felt being disposed against the surface of the dryer cans.

9. The method of claim 1 wherein the moisture content of the wet web after all pressing operations and of the aqueous additive dispersion is in the range of about 50–60%.

10. The method of claim 1 wherein said aqueous additive dispersion comprises lignosulfonate based spent liquor.

11. The method of claim 10 wherein said aqueous additive dispersion comprises a blend of lignosulfonate based spent liquor and starch.

12. The method of claim 11 wherein the blend comprises about 50% starch and 50% lignosulfonate on a dry basis.

13. The method of claim 10 wherein said aqueous additive dispersion comprises a blend of lignosulfonate based spent liquor and mica.

14. The method of claim 13 wherein the blend comprises about 50% mica and 50% lignosulfonate on a dry basis.

* * * * *